US010629159B2

(12) United States Patent
Ueda

(10) Patent No.: US 10,629,159 B2
(45) Date of Patent: Apr. 21, 2020

(54) IMAGE PROCESSING APPARATUS, DISPLAY APPARATUS, AND IMAGE PROCESSING METHOD

(71) Applicant: SEIKO EPSON CORPORATION, Tokyo (JP)

(72) Inventor: Yuki Ueda, Matsumoto (JP)

(73) Assignee: SEIKO EPSON CORPORATION, Tokyo (JP)

( * ) Notice: Subject to any disclaimer, the term of this patent is extended or adjusted under 35 U.S.C. 154(b) by 158 days.

(21) Appl. No.: 15/908,246

(22) Filed: Feb. 28, 2018

(65) Prior Publication Data

US 2018/0268778 A1 Sep. 20, 2018

(30) Foreign Application Priority Data

Mar. 16, 2017 (JP) ..... 2017-051918

(51) Int. Cl.

| | |
|---|---|
| ***G09G 5/18*** | (2006.01) |
| ***G09G 5/12*** | (2006.01) |
| ***G09G 5/00*** | (2006.01) |
| ***G09G 3/288*** | (2013.01) |
| ***G09G 3/00*** | (2006.01) |

(52) U.S. Cl.

CPC ..... *G09G 5/006* (2013.01); *G09G 3/002* (2013.01); *G09G 3/288* (2013.01); *G09G 5/18* (2013.01); *G09G 5/12* (2013.01); *G09G 2340/0435* (2013.01)

(58) Field of Classification Search

CPC ..... G09G 5/18; G09G 5/006; G09G 3/18; G09G 5/12

See application file for complete search history.

(56) References Cited

U.S. PATENT DOCUMENTS

| | | | | |
|---|---|---|---|---|
| 4,942,365 | A * | 7/1990 | Satterwhite | H03D 1/2245 327/41 |
| 5,485,220 | A * | 1/1996 | McNeilly | H04N 5/08 348/525 |
| 5,999,222 | A * | 12/1999 | Xie | H04N 5/10 348/500 |
| 6,473,134 | B1 * | 10/2002 | Nohara | H04B 7/0808 348/614 |
| 7,701,512 | B1 * | 4/2010 | Woodall | G09G 5/12 348/526 |
| 8,081,870 | B2 * | 12/2011 | Ito | H04N 5/4401 386/278 |
| 8,692,938 | B2 * | 4/2014 | Kuwabara | H04N 5/04 348/425.4 |
| 2003/0107563 | A1 | 6/2003 | Sato | |

(Continued)

FOREIGN PATENT DOCUMENTS

| | | |
|---|---|---|
| JP | 2003-140604 A | 5/2003 |
| JP | 2011-4107 A | 1/2011 |

*Primary Examiner* — Ricardo Osorio

(74) *Attorney, Agent, or Firm* — Oliff PLC

(57) ABSTRACT

An image processing apparatus includes a determining section that determines an evaluation period relating to a sync signal according to a processing timing of image information, a signal outputting section that outputs a timing signal in a case where the sync signal is not received in the evaluation period, and a control section that controls the processing timing in accordance with the timing signal.

7 Claims, 5 Drawing Sheets

(56) References Cited

U.S. PATENT DOCUMENTS

2005/0273657 A1* 12/2005 Ichiki ..... H04L 12/2805
714/25
2011/0007215 A1* 1/2011 Hori ..... G09G 5/005
348/510

* cited by examiner

IMAGE PROCESSING APPARATUS, DISPLAY APPARATUS, AND IMAGE PROCESSING METHOD

CROSS-REFERENCE

The entire disclosure of Japanese Patent Application No. 2017-051918, filed Mar. 16, 2017 is expressly incorporated by reference herein.

BACKGROUND

1. Technical Field

The present invention relates to an image processing apparatus, a display apparatus, and an image processing method.

2. Related Art

An image processing apparatus receives image information and a sync signal and processes the image information at a timing according to the sync signal. JP-A-2011-4107 describes an image processing apparatus that outputs a signal that replaces the sync signal in a case where the sync signal has not been received at a normal timing.

The characteristics of the periodicity of the sync signal (frequency of sync signal, for example) varies to some extent due, for example, to a transmission path along which the sync signal is transmitted. In the case where the sync signal cannot be received at the normal timing, the image processing apparatus described in JP-A-2011-4107 outputs a signal that replaces the sync signal. Therefore, in the case where the frequency of the sync signal varies to some extent due, for example, to the transmission path, the image processing apparatus undesirably outputs the signal that replaces the sync signal.

SUMMARY

An advantage of some aspects of the invention is to provide a technology for preventing a signal that replaces a sync signal from being outputted when the frequency of the sync signal varies to some extent.

An image processing apparatus according to an aspect of the invention includes a determining section that determines an evaluation period relating to a sync signal according to a processing timing of image information, a signal outputting section that outputs a timing signal in a case where the sync signal is not received in the evaluation period, and a control section that controls the processing timing in accordance with the timing signal.

According to the aspect described above, even if the frequency of the sync signal varies to some extent, a situation in which the timing signal, which replaces the sync signal, is outputted can be avoided.

In the image processing apparatus according to the aspect described above, it is preferable that the signal outputting section outputs the sync signal in a case where the sync signal is received in the evaluation period, and that the control section controls the processing timing in accordance with the timing signal in the case where the signal outputting section outputs the timing signal and controls the processing timing in accordance with the sync signal in the case where the signal outputting section outputs the sync signal. According to the aspect with the configuration described above, the processing timing can be controlled by the output from the signal outputting section, for example, even if the sync signal is lost.

It is preferable that the image processing apparatus according to the aspect described above further includes a measuring section that measures a value relating to periodicity of the sync signal, and that the determining section determines the evaluation period based on a result of the measurement performed by the measuring section. According to the aspect with the configuration described above, the evaluation period can be determined based on the periodicity of the sync signal.

In the image processing apparatus according to the aspect described above, it is preferable that the value relating to periodicity of the sync signal is a frequency of the sync signal. According to the aspect with the configuration described above, the evaluation period can be determined based on the frequency of the sync signal.

In the image processing apparatus according to the aspect described above, it is preferable that the determining section uses an average of the frequencies of the sync signal from which a first predetermined value is subtracted to determine an end timing of the evaluation period. According to the aspect with the configuration described above, the end timing of the evaluation period can be adjusted in accordance with the first predetermined value.

In the image processing apparatus according to the aspect described above, it is preferable that the determining section uses an average of the frequencies of the sync signal to which a second predetermined value is added to determine a start timing of the evaluation period. According to the aspect with the configuration described above, the start timing of the evaluation period can be adjusted in accordance with the second predetermined value.

It is preferable that the image processing apparatus according to the aspect described above further includes a delaying section that delays the output from the signal outputting section, and that the control section controls the processing timing in accordance with the output outputted from the signal outputting section and delayed by the delaying section. According to the aspect with the configuration described above, the output from the signal outputting section can be delayed as required.

A display apparatus according to another aspect of the invention includes the image processing apparatus described above. According to the aspect described above, in the display apparatus, even if the frequency of the sync signal varies to some extent, a situation in which the timing signal, which replaces the sync signal, is outputted can be avoided.

An image processing method according to another aspect of the invention includes determining an evaluation period relating to a sync signal according to a processing timing of image information, outputting a timing signal in a case where the sync signal is not received in the evaluation period, and controlling the processing timing in accordance with the timing signal in the case where the timing signal is outputted.

According to the aspect described above, even if the frequency of the sync signal varies to some extent, a situation in which the timing signal, which replaces the sync signal, is outputted can be avoided.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
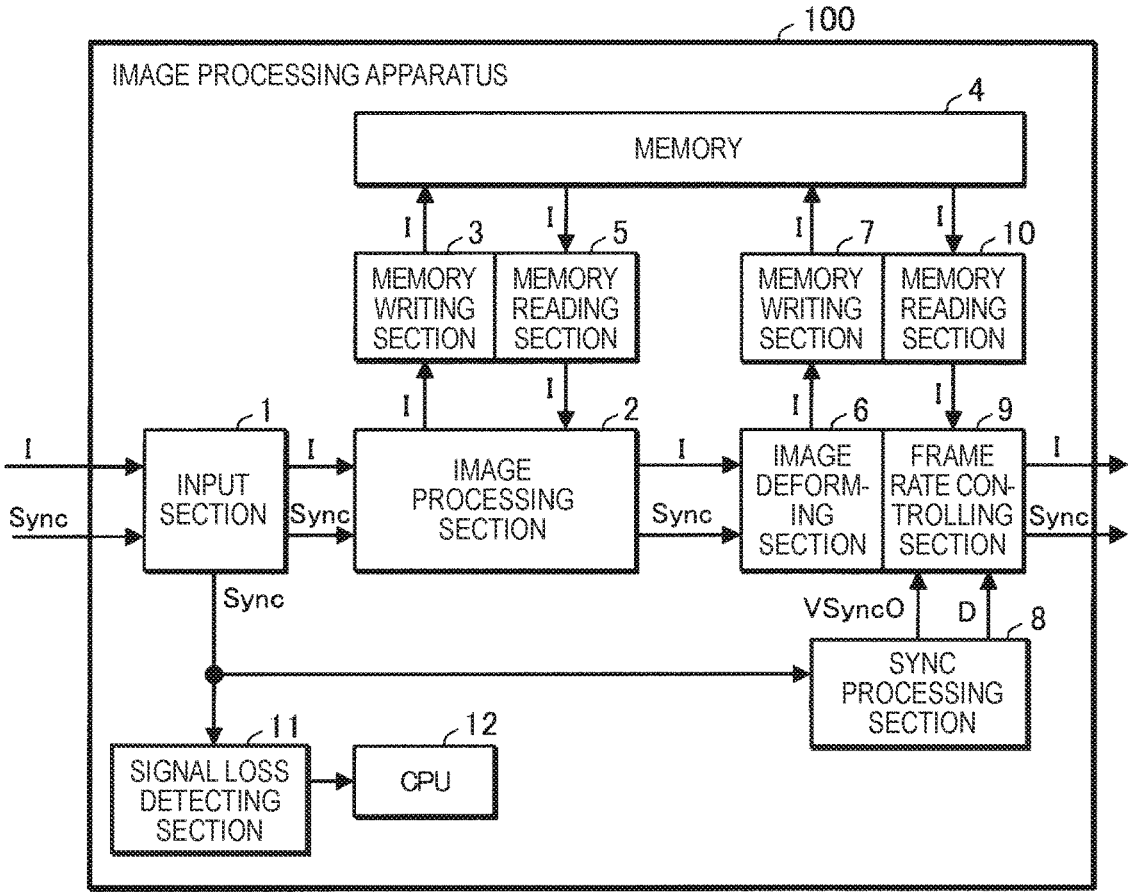
FIG. 1 shows an image processing apparatus according to a first embodiment.

An embodiment according to the invention will be described below with reference to the drawings. In the drawings, the dimension and scale of each portion differ from actual values as appropriate. Further, the embodiment described below is a preferable specific example of the invention. A variety of technically preferable restrictions are therefore imposed on the embodiment. However, the scope of the invention is not limited to the restricted forms unless otherwise it is particularly stated in the following description that a restriction is imposed on the invention.

First Embodiment

FIG. 1 shows an image processing apparatus 100 according to a first embodiment.

The image processing apparatus 100 is, for example, built in a display apparatus, such as a projector. The image processing apparatus 100 includes an input section 1, an image processing section 2, a memory writing section 3, a memory 4, a memory reading section 5, an image deforming section 6, a memory writing section 7, a sync processing section 8, a frame rate controlling section 9, a memory reading section 10, a signal loss detecting section 11, and a CPU (central processing unit) 12.

The memory writing sections 3 and 7 each develop image information I, which represents an image, in the memory 4, such as a frame memory. The memory reading section 5 reads the image information I which has been developed in the memory 4 by the memory writing section 3 and on which image processing has been performed. The memory reading section 10 reads the image information I which has been developed in the memory 4 by the memory writing section 7 and which has been deformed.

The input section 1 receives, via a cable, for example, image information I and a sync signal Sync according to the processing timing of the image information I. The sync signal Sync contains a horizontal sync signal HSync and a vertical sync signal VSync.

The image processing section 2 uses the memory writing section 3 to develop the image information I at the timing according to the sync signal Sync and performs image processing (for example, digital zooming, color tone correction, luminance correction, and sharpness adjustment) on the image information I developed in the memory 4. The image processing is not limited to the digital zooming, color tone correction, luminance correction, or sharpness adjustment and can be changed as appropriate. The image processing section uses the memory reading section 5 to read the image information I (image information I on which image processing has been performed) from the memory 4 at the timing according to the sync signal Sync.

The image deforming section 6 uses the memory writing section 7 to develop the image information I in the memory 4 at the timing according to the sync signal Sync and deforms (for example, performs trapezoidal distortion correction) the image information I developed in the memory 4. The deformation is not limited to the trapezoidal distortion correction and can be changed as appropriate.

The sync processing section 8 is formed of hardware, such as an electronic circuit (sync processing circuit, for example). The sync processing section 8, when it receives the vertical sync signal VSync via the input section 1 in an evaluation period for evaluating whether or not the vertical sync signal VSync, which is the sync signal, is present, outputs the vertical sync signal VSync as an output sync signal VSyncO.

The sync processing section 8, when it does not receive the vertical sync signal VSync in the evaluation period, produces a timing signal TSync and outputs the timing signal TSync as the output sync signal VSyncO.

The sync processing section 8, when it does not receive the vertical sync signal VSync in the evaluation period, further outputs loss information D representing that the sync signal Sync has been lost.

The sync processing section 8 will be described later in detail.

The frame rate controlling section 9 is an example of a control section. The frame rate controlling section 9 controls the processing timing of the image information I in accordance with the output sync signal VSyncO. Specifically, the frame rate controlling section 9 uses the memory reading section 10 to read the image information I deformed by the image deforming section 6 in the memory 4 at the timing according to the output sync signal VSyncO.

The frame rate controlling section 9, when it keeps receiving the loss information D for at least a predetermined period, may stop reading the image information I.

In the present embodiment, the frame rate controlling section 9 is integrated with the image deforming section 6.

The signal loss detecting section 11 executes software (program) to detect loss of the sync signal Sync, specifically, loss of the vertical sync signal VSync. The signal loss detecting section 11, when it detects loss of the vertical sync signal VSync, outputs loss notification to the CPU 12.

The CPU 12 executes software to perform a variety of actions. For example, the CPU 12, when it receives the loss notification, causes a display section (projection section, for example) that is not shown to perform display operation of notifying a user that the vertical sync signal VSync has been lost.

Figure 2:
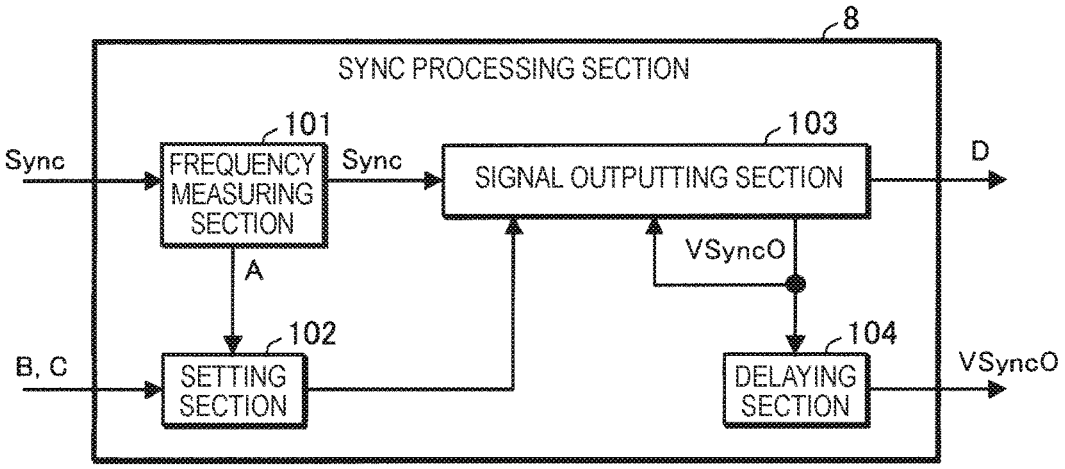
FIG. 2 shows an example of a sync processing section.

FIG. 2 shows an example of the sync processing section 8. The sync processing section 8 includes a frequency measuring section 101, a setting section 102, a signal outputting section 103, and a delaying section 104.

The frequency measuring section 101 is an example of a measurement section and is formed of hardware, for example, an electronic circuit (frequency measuring circuit), such as an FPGA (field programmable gate array) or an ASIC (application specific IC). The frequency measuring section 101 measures the frequency of the sync signal Sync, specifically, the frequency of the vertical sync signal VSync. The frequency of the sync signal Sync (frequency of vertical sync signal VSync) is an example of a value relating to the periodicity of the sync signal.

The setting section 102 is an example of a determination section and is formed of hardware, for example, an electronic circuit (setting circuit, for example), such as an FPGA or an ASIC. The setting section 102 determines the evaluation period for evaluating whether or not the vertical sync signal VSync is present. The setting section 102 sets the determined evaluation period in the signal outputting section 103.

The signal outputting section 103 is formed of hardware, for example, an electronic circuit (signal outputting circuit, for example), such as an FPGA or an ASIC. The signal outputting section 103, when it receives the vertical sync signal VSync in the evaluation period, outputs the vertical sync signal VSync as the output sync signal VSyncO. The signal outputting section 103, when it does not receive the vertical sync signal VSync in the evaluation period, produces the timing signal TSync and outputs the timing signal TSync as the output sync signal VSyncO.

The delaying section 104 is formed of hardware, for example, an electronic circuit (delay circuit, for example), such as an FPGA or an ASIC. The delaying section 104 delays the output sync signal VSyncO, which is the output from the signal outputting section 103. The amount of delay produced by the delaying section 104 is set in accordance with the amount of delay produced when the vertical sync signal VSync passes through the image processing section 2. For example, the amount of delay produced by the delaying section 104 is set to be equal to the period required for the vertical sync signal VSync inputted to the image processing section 2 to be outputted from the image processing section 2 (amount of delay produced by image processing section 2).

The action of the sync processing section 8 will next be described.

The frequency measuring section 101 measures the frequency of the vertical sync signal VSync inputted via the input section 1 for multiple frames (several tens of frames, for example) of the image information I. The period for which the frequency of the vertical sync signal VSync is measured is not limited to the several tens of frames of the image information I and can be changed as appropriate. The frequency measuring section 101 subsequently calculates the average A of the measured frequencies of the vertical sync signal VSync. The frequency measuring section 101 subsequently outputs the average A to the setting section 102.

Having received the average A, the setting section 102 uses the average A and a first predetermined value and a second predetermined value stored in advance in a register that is not shown to determine the evaluation period.

Figure 3:
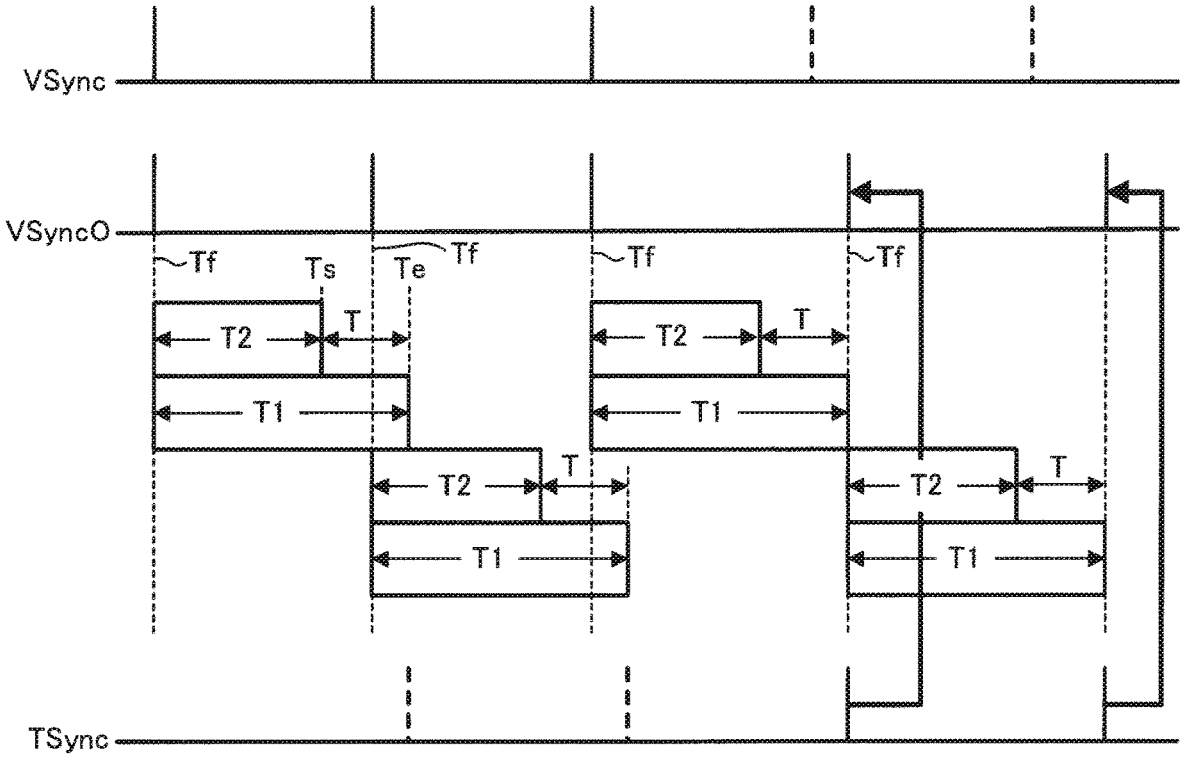
FIG. 3 describes an evaluation period.

FIG. 3 describes the evaluation period T.

The setting section 102 uses the average A from which the first predetermined value is subtracted (hereinafter also referred to as "Min frequency") to determine an end timing Te of the evaluation period T. In the example shown in FIG. 3, the setting section 102 determines, as the end timing Te of the evaluation period T, the timing when a period T1 determined by the reciprocal of the Min frequency has elapsed from a reference timing (output timing of preceding output sync signal VSyncO) Tf.

The setting section 102 further uses the average A to which the second predetermined value is added (hereinafter also referred to as "Max frequency") to determine a start timing Ts of the evaluation period T. In the example shown in FIG. 3, the setting section 102 determines, as the start timing Ts of the evaluation period T, the timing when a period T2 determined by the reciprocal of the Max frequency has elapsed from the reference timing Tf.

The setting section 102 subsequently sets the evaluation period T in the signal outputting section 103. For example, the setting section 102 outputs start timing information representing the start timing Ts and end timing information representing the end timing Te to the signal outputting section 103 to set the evaluation period T in the signal outputting section 103.

The signal outputting section 103 does not output the output sync signal VSyncO even when it receives some signal in the period (period T2) after the reference timing Tf but before the start timing Ts. Therefore, in a case where the signal outputting section 103 receives, for example, noise in the period T2, a situation in which the signal outputting section 103 takes the noise to be the vertical sync signal VSync and outputs the output sync signal VSyncO can be avoided.

The signal outputting section 103, when it receives the vertical sync signal VSync in the evaluation period T, outputs the vertical sync signal VSync as the output sync signal VSyncO. Therefore, even if the frequency of the vertical sync signal VSync varies to some extent, a situation in which the timing signal TSync, which replaces the sync signal, is outputted can be avoided.

The signal outputting section 103, when it does not receive the vertical sync signal VSync in the period after the reference timing Tf but before the end timing Te (period T1), produces the timing signal TSync in accordance with the end timing Te and outputs the timing signal TSync as the output sync signal VSyncO. Therefore, for example, even if the cable connected to the input section 1 is disconnected and the vertical sync signal VSync is not inputted to the signal outputting section 103, the timing signal TSync can be outputted as the output sync signal VSyncO.

The signal outputting section 103, when it does not receive the vertical sync signal VSync in a period T1, further outputs the loss information D.

The delaying section 104 delays the output sync signal VSyncO and outputs the delayed output sync signal VSyncO to the frame rate controlling section 9. The delaying section 104 further delays the loss information D and outputs the delayed loss information D to the frame rate controlling section 9, as in the case of the output sync signal VSyncO.

The frame rate controlling section 9 uses the memory reading section 10 to read, at the timing according to the output sync signal VSyncO, the image information I deformed by the image deforming section 6 in the memory 4.

The image processing apparatus 100 and the image processing method according to the present embodiment can prevent the timing signal TSync, which replaces the sync signal, from being outputted even if the frequency of the vertical sync signal VSync varies to some extent.

Figure 4:
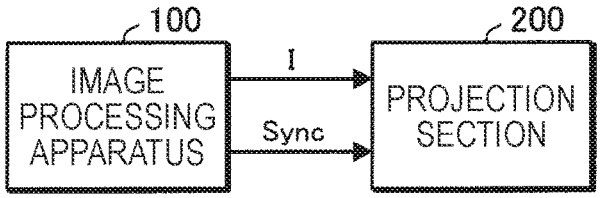
FIG. 4 shows an example of a projector.

The image processing apparatus 100 according to the present embodiment may be used in a display apparatus, such as a projector, as shown in FIG. 4. The projector (display apparatus) shown in FIG. 4 includes the image processing apparatus 100 and a projection section 200. The projection section 200 displays the image information I outputted by the image processing apparatus 100 on a projection surface (not shown) by using the sync signal Sync outputted by the image processing apparatus 100.

In the present embodiment, in which the sync processing section 8 is formed of hardware, the function provided by the sync processing section 8 can be performed in a shorter processing period than in a configuration in which the function is achieved by using software.

Comparative Example 1

Figure 5:
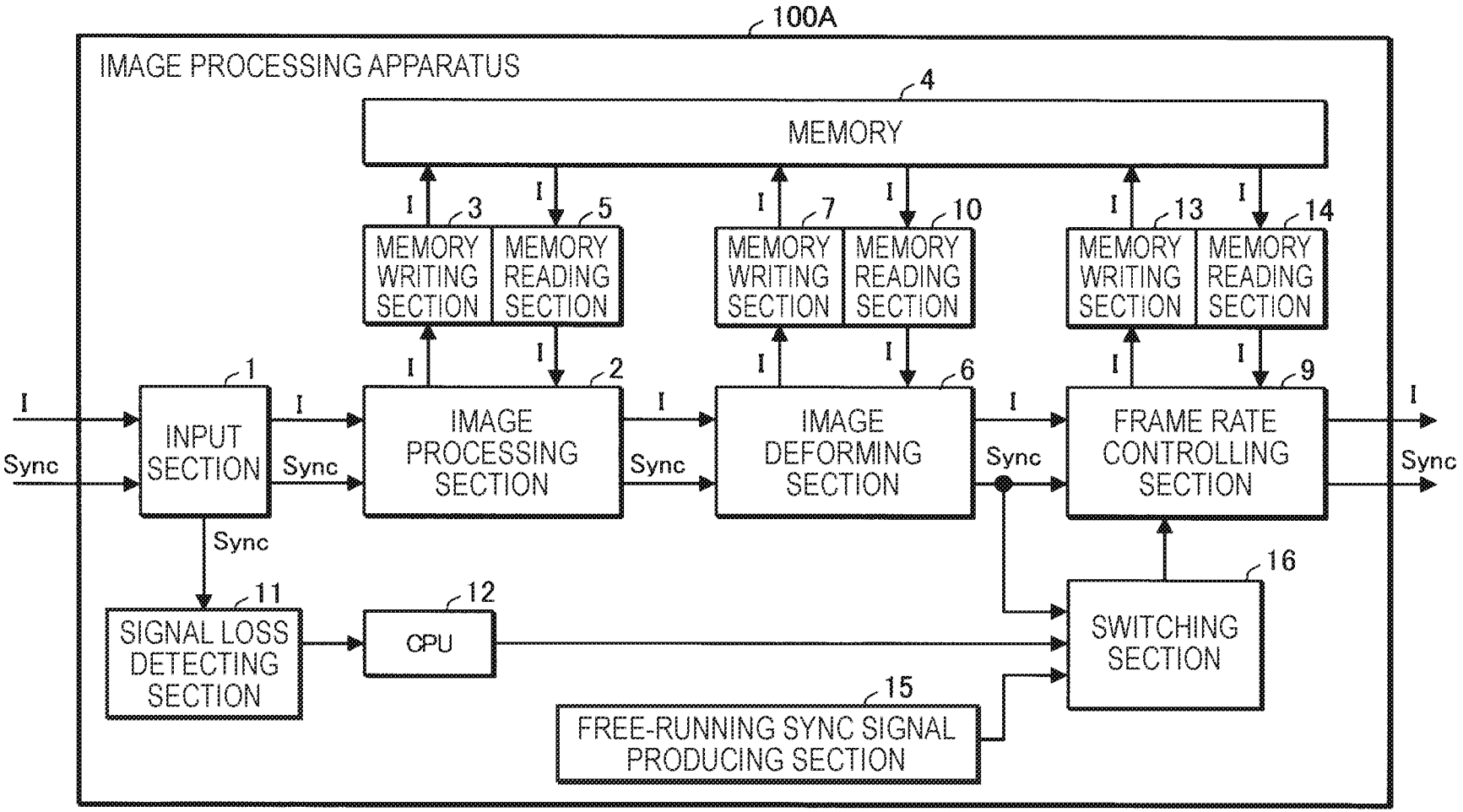
FIG. 5 shows Comparative example 1.

FIG. 5 shows as Comparative example 1 an image processing apparatus 100A in which part of the functions provided by the sync processing section 8 is achieved by using software. In FIG. 5, the same components as those shown in FIG. 1 have the same reference characters.

In the image processing apparatus 100A, the sync processing section 8 is removed from the elements provided in the image processing apparatus 100, and a memory writing section 13, a memory reading section 14, a free-running sync signal producing section 15, and a switching section 16 are added to the elements provided in the image processing apparatus 100.

The image deforming section 6 uses the memory reading section 10 to read the image information I from the memory 4 at the timing according to the sync signal Sync.

The frame rate controlling section 9 uses the memory writing section 13 to develop the image information I in the memory 4 at the timing according to the sync signal Sync and uses the memory reading section 14 to read the image information I from the memory 4 at the timing according to the vertical sync signal VSync. The free-running sync signal producing section 15 produces a sync signal that replaces the vertical sync signal VSync.

The CPU 12, when it receives the loss notification from the signal loss detecting section 11, outputs a switching instruction to the switching section 16. The switching section 16, when it does not receive the switching instruction from the CPU 12, outputs the vertical sync signal VSync inputted from the image deforming section 6 to the frame rate controlling section 9. On the other hand, the switching section 16, when it receives the switching instruction from the CPU 12, outputs the sync signal produced by the free-running sync signal producing section 15 to the frame rate controlling section 9.

The signal loss detecting section 11 and the CPU 12, which operate under execution of software, are likely to operate slower than the sync processing section 8 formed of hardware in the present embodiment. Therefore, in Comparative example 1, the switching timing of the output signal from the switching section 16 is later than the timing when the frame rate controlling section 9 requires the sync signal, resulting in a possible decrease in image quality.

In contrast, use of the sync processing section 8 formed of hardware, as in the present embodiment, allows the sync signal (output sync signal VSyncO) to be outputted to the frame rate controlling section 9 earlier than in Comparative example 1. Therefore, according to the present embodiment, the possibility of a decrease in image quality can be reduced as compared with Comparative example 1.

Comparative Example 2

Figure 6:
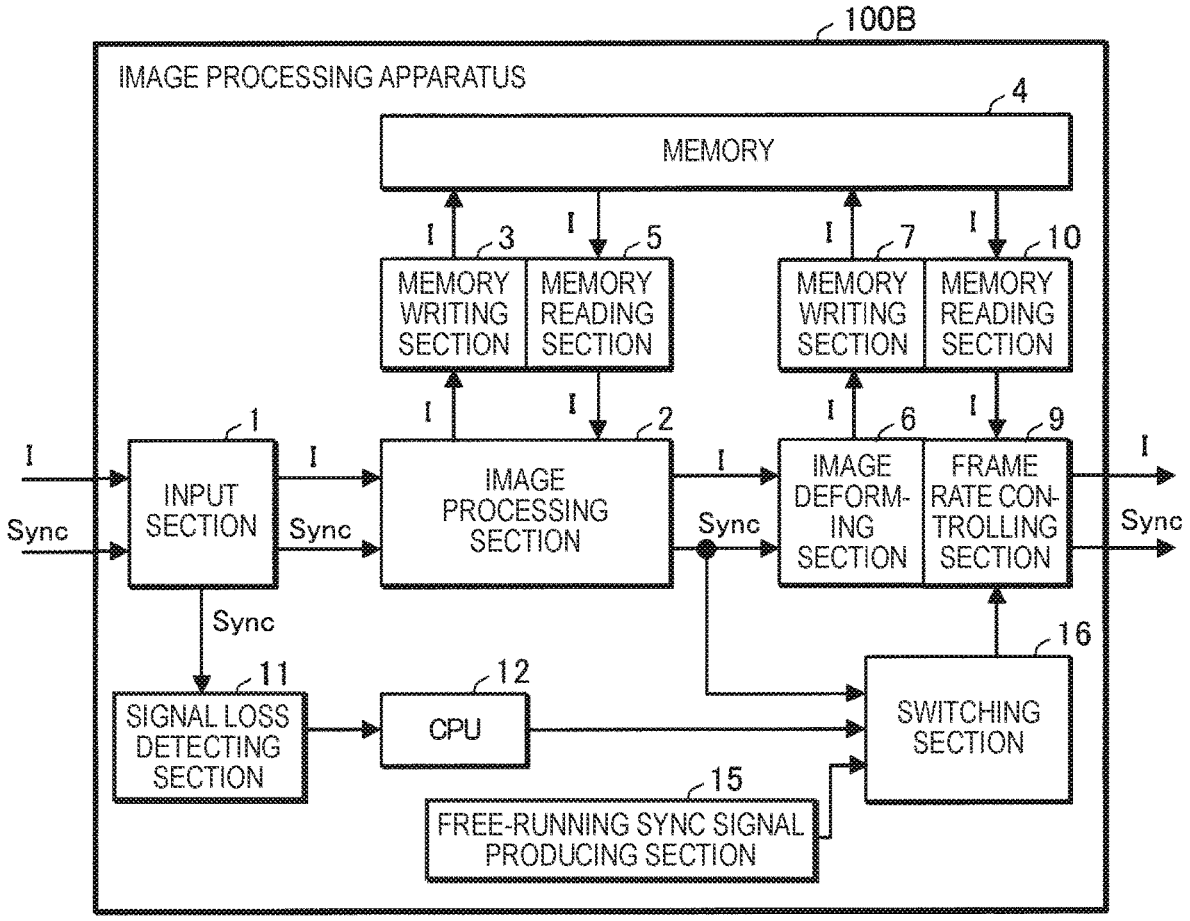
FIG. 6 shows Comparative example 2.

FIG. 6 shows an image processing apparatus 100B according to Comparative example 2. In FIG. 6, the same components as those shown in FIG. 5 have the same reference characters. In Comparative example 2, the image deforming section 6 and the frame rate controlling section 9, which are separate components in Comparative example 1, are integrated with each other.

In the image processing apparatus 100B, a smaller number of processes using the memory 4 is carried out than in the image processing apparatus 100A shown in FIG. 5. Therefore, in the image processing apparatus 100B (Comparative example 2), the timing when the frame rate controlling section 9 requires the sync signal is earlier than in the image processing apparatus 100A (Comparative example 1). Therefore, in Comparative example 2, the switching timing of the output signal from the switching section 16 is later than the timing when the frame rate controlling section 9 requires the sync signal than in Comparative example 1, resulting in an increase in the possibility of a decrease in image quality.

In contrast, use of the sync processing section 8 formed of hardware, as in the present embodiment, allows the sync signal (output sync signal VSyncO) to be outputted to the frame rate controlling section 9 earlier than in Comparative example 2. Therefore, according to the present embodiment, the possibility of a decrease in image quality can be reduced as compared with Comparative example 2.

Comparative Example 3

Figure 7:
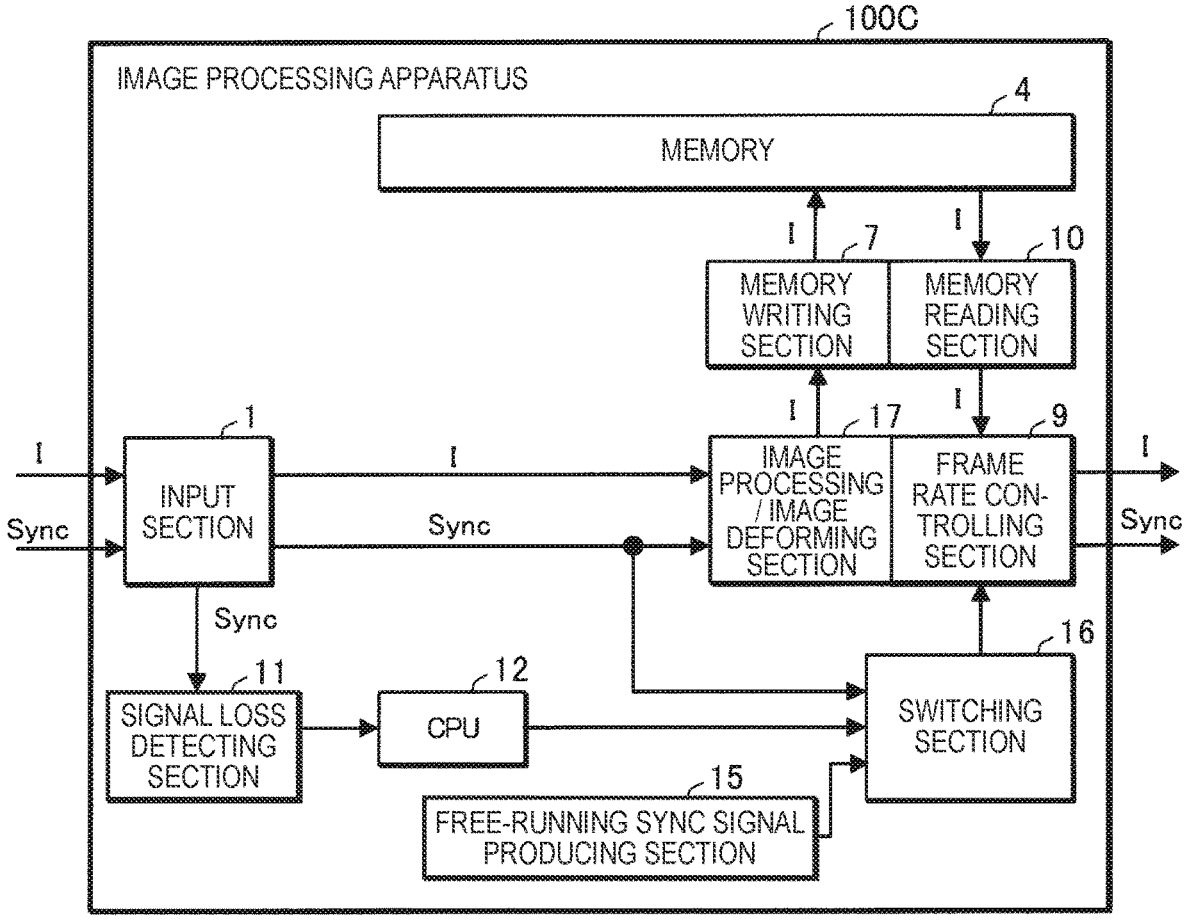
FIG. 7 shows Comparative example 3.

FIG. 7 shows an image processing apparatus 100C according to Comparative example 3. In FIG. 7, the same components as those shown in FIG. 5 have the same reference characters. In Comparative example 3, the image processing section 2 and the image deforming section 6, which are separate components, are integrated with each other into an image processing/image deforming section 17.

In the image processing apparatus 100C, a further smaller number of processes using the memory 4 is carried out than in the image processing apparatus 100B shown in FIG. 6. Therefore, in the image processing apparatus 100C (Comparative example 3), the timing when the frame rate controlling section 9 requires the sync signal is earlier than in the image processing apparatus 100B (Comparative example 2). Therefore, in the image processing apparatus 100C (Comparative example 3), the switching timing of the output signal from the switching section 16 is later than the timing when the frame rate controlling section 9 requires the sync signal than in Comparative example 2, resulting in an increase in the possibility of a decrease in image quality.

In contrast, use of the sync processing section 8 formed of hardware, as in the present embodiment, allows the sync signal (output sync signal VSyncO) to be outputted to the frame rate controlling section 9 earlier than in Comparative example 3. Therefore, according to the present embodiment, the possibility of a decrease in image quality can be reduced as compared with Comparative example 3.

Variations

The invention is not limited to the embodiment described above. For example, a variety of variations that will be described below are conceivable. Further, arbitrarily selected one or more of the plurality of variation aspects that will be described below can be combined with one another as appropriate.

Variation 1

The value relating to the periodicity of the sync signal is not limited to the frequency of the vertical sync signal VSync and can be changed as appropriate. For example, the value relating to the periodicity of the sync signal may instead be the cycle of the vertical sync signal VSync. In this case, the frequency measuring section 101 is replaced with a cycle measuring section that measures the cycle of the vertical sync signal VSync and calculates the average of the results of the measurement of the cycle (average of cycles). The setting section 102 uses the average of the cycles to which a first specific value is added to determine the end timing Te of the evaluation period T and uses the average of the cycles from which a second specific value is subtracted to determine the start timing Ts of the evaluation period T. The first and second specific values are, for example, stored in advance in the register that is not shown.

Variation 2

The signal outputting section 103 may not output the loss information D.

Variation 3

The image deforming section 6 and the frame rate controlling section 9 may be integrated with each other, as shown in FIG. 1, or may be separate from each other, as shown in FIG. 5. Further, the image processing section 2 and the image deforming section 6 may be separate from each other, as shown in FIG. 1, or may be integrated with each other into the image processing/image deforming section 17, as shown in FIG. 7. The image processing section 2, the image deforming section 6, and the frame rate controlling section 9 may be integrated with one another, as shown in FIG. 7.

Variation 4

The signal loss detecting section 11, the CPU 12, and the delaying section 104 may each be omitted. In the case where the delaying section 102 is omitted, the output sync signal VSyncO and the loss information D are outputted from the signal outputting section 103 to the frame rate controlling section 9.

Variation 5

The image processing section 2 may be provided in a position upstream of the frame rate controlling section 9 in place of the image deforming section 6. In this case, the image deforming section 6 may be omitted.

The image processing section 2 may be omitted instead of the image deforming section 6.

Variation 6

The period T1 (see FIG. 3) may be used as the evaluation period T. In this case, since the period T2 can be omitted, the setting section 102 does not need to add the second predetermined value to the average A, and the second predetermined value can therefore omitted.

Variation 7

The memory (frame memory) 4 may be physically divided into a portion (frame memory) used by the image processing section 2 and a portion (frame memory) used by the image deforming section 6.

Variation 8

Information representing a reference frequency corresponding to the frequency of the vertical sync signal VSync may be set in the setting section 102, and the setting section 102 may use the reference frequency in place of the average A outputted by the frequency measuring section 101. In this case, the frequency measuring section 101 can be omitted.

Variation 9

A projector is used as the display apparatus, but the display apparatus is not limited to a projector and can be changed as appropriate. For example, the display apparatus may be a direct-view display (such as liquid crystal display, organic EL (electro-luminescence) display, plasma display, and CRT (cathode ray tube) display). In this case, the projection section 200 shown in FIG. 4 is replaced with a direct-view display section.

What is claimed is:

1. An image processing apparatus comprising:

at least one processor and/or circuit configured to:

receive a sync signal according to a processing timing of image information;

measure a value relating to periodicity of the sync signal including a frequency of the sync signal;

determine an evaluation period based on a result of the measured value, in which an end timing of the evaluation period is determined based on an average of the frequencies of the sync signal from which a first predetermined value is subtracted;

output a timing signal in a case where the sync signal is not received in the evaluation period; and control the processing timing in accordance with the timing signal.

2. The image processing apparatus according to claim 1, wherein the at least one processor and/or circuit outputs the sync signal in a case where the sync signal is received in the evaluation period, and the at least one processor and/or circuit controls the processing timing in accordance with the timing signal in the case where the at least one processor and/or circuit outputs the timing signal and controls the processing timing in accordance with the sync signal when the sync signal is output.

3. The image processing apparatus according to claim 1, wherein the at least one processor and/or circuit determines a start timing of the evaluation period based on an average of the frequencies of the sync signal to which a second predetermined value is added.

4. The image processing apparatus according to claim 1, wherein the at least one processor and/or circuit is further configured to:

delay the output, and control the processing timing in accordance with the delayed output.

5. A display apparatus comprising the image processing apparatus according to claim 1.

6. An image processing method comprising:

receiving a sync signal according to a processing timing of image information;

measuring a value relating to periodicity of the sync signal including a frequency of the sync signal;

determining an evaluation period based on a result of the measured value, in which an end timing of the evaluation period is determined based on an average of the frequencies of the sync signal from which a first predetermined value is subtracted;

outputting a timing signal in a case where the sync signal is not received in the evaluation period; and controlling the processing timing in accordance with the timing signal in the case where the timing signal is outputted.

7. An image processing apparatus comprising:

at least one processor and/or circuit configured to:

receive a sync signal according to a processing timing of image information;

measure a value relating to periodicity of the sync signal including a frequency of the sync signal;

determine an evaluation period based on a result of the measured value, in which a start timing of the evaluation period is determined based on an average of the frequencies of the sync signal to which a second predetermined value is added;

output a timing signal in a case where the sync signal is not received in the evaluation period; and control the processing timing in accordance with the timing signal.

* * * * *